US005931688A

United States Patent [19]

Hasz et al.

[11] Patent Number: 5,931,688

[45] Date of Patent: Aug. 3, 1999

[54] SELF DOCKETING ELECTRICAL CONNECTOR ASSEMBLY

[75] Inventors: Richard Eric Hasz, Ramseur; Lynn Wilson Abernethy, Clemmons; David Maurice Wolla, Winston-Salem; John Rudell Bussard, Kernersville; Donald Robert Worthington, Pfafftown; Bruce Edwin Chapman, Kernersville, all of N.C.

[73] Assignee: The Whitaker Company, Wilmington, Del.

[21] Appl. No.: 08/926,198

[22] Filed: Sep. 9, 1997

Related U.S. Application Data

[60] Provisional application No. 60/026,144, Sep. 16, 1996.

[51] Int. Cl.[6] ..... H01R 13/74

[52] U.S. Cl. ..... 439/247; 439/553

[58] Field of Search ..... 439/248, 247, 439/557, 545, 76, 553, 555, 556

[56] References Cited

U.S. PATENT DOCUMENTS

| | | | |
|---|---|---|---|
| 4,909,748 | 3/1990 | Kozono et al. | 439/247 |
| 5,002,497 | 3/1991 | Plocek et al. | 439/248 |
| 5,127,852 | 7/1992 | Gravens et al. | 439/545 |
| 5,205,755 | 4/1993 | Douty et al. | 439/247 |
| 5,575,673 | 11/1996 | Dahlem et al. | 439/248 |
| 5,607,323 | 3/1997 | Foster et al. | 439/557 |
| 5,620,329 | 4/1997 | Kidd et al. | 439/248 |

*Primary Examiner*—Gary Paumen
*Assistant Examiner*—Alexander Gilman

[57] ABSTRACT

An electrical connector assembly for mounting an electrical component, such as a radio, on a panel. The connector assembly permits blind mating of a radio in a dash. A header on the radio is mated to a plug connector on a wiring harness. The plug connector is mounted on a mounting member on a panel. When the component is inserted through an opening, such as an opening in an automobile dash, the plug connector can shift into alignment with a header on the component. Ramps on the header and on the plug connector cam the mating connectors into alignment permitting movement in a plane perpendicular to the mating direction. Alignment and movement in the mating direction is permitted by springs holding the plug connector on the housing. Metal springs exerting a mating force when deflected can be use. Alternatively molded cantilever latches can be deflected. The mated connectors can still move in the axial direction after mating.

10 Claims, 6 Drawing Sheets

SELF DOCKETING ELECTRICAL CONNECTOR ASSEMBLY

This application claims benefit of provisional application Ser. No. 60/026,144 filed Sep. 16, 1996.

BACKGROUND OF THE INVENTION

1. Field of the Invention

This invention is related to electrical connectors employed to attach an electrical component to a harness. More particularly this invention is related to electrical connector that permit an electrical component to be mounted in a larger assembly such as an automobile dash or instrument panel. More specifically this invention is related to self docking electrical connectors that can be aligned during mating to permit the connectors to be blind mated.

2. Description of the Prior Art

Electrical components, such as radios, are normally hand assembled into the dash or instrument panel of an automobile. An electrical harness is typically mounted behind a panel positioned in front of the firewall of the automobile. Wires and heating ducts typically extend between this panel and the firewall. One method of assembling individual components, such as radios, to these harnesses is to provide sufficient slack so that the connection can be made before positioning the component in the dash or instrument panel. A more desirable assembly method is to mount a plug connector to the panel and then to mate a header on the electrical component to the plug connector. The electrical component should be mounted after the dash has been assembled to the panel on which the plug connector is mounted. The electrical component can then be inserted through an opening in the dash and the header on the component is blind mated with the plug connector. The problem with this approach is that adequate alignment between the dash and the panel cannot be assured and therefore the opening in the dash may not be properly aligned with the plug connector.

One connector assembly that permits blind mating of electrical components, such as radios, is disclosed in U.S. Pat. No. 4,963,098. That patent includes a header with a tapered alignment post that engages a corresponding slot in a plug connector subassembly. The plug connector subassembly includes flanges that mount the plug connector subassembly on a panel, but the plug connector subassembly is free to move parallel to the panel. The tapered alignment post then can cam the plug connector assembly into alignment just prior to mating. A related approach is disclosed in U.S. Pat. No. 4,921,435 where a resilient O ring is used to initially center the plug connector assembly.

Although each of these approaches permit movement parallel to the automotive panel, misalignment can also occur in a direction perpendicular to the automotive panel. Therefore, some travel in the direction perpendicular to the panel and parallel to the axis along which the connectors move during mating is also desirable. Furthermore it the alignment post disclosed in these patents does occupy a large area that cannot otherwise be used. The contact density is therefore affected.

SUMMARY OF THE INVENTION

The instant invention permits travel between mating plug and header connectors in three mutually perpendicular directions, and not just laterally parallel to the panel on which one of the connectors is mated. This invention also includes spring members that when deflected generate enough force to insure that the connectors are mated and the mated connector assembly is them free to move if necessary.

One additional objective of this invention is to minimize the size of any alignment features on the mating connectors. Additionally this connector assembly should be compatible with existing connectors that are used in these applications. Furthermore, the connectors should be suitable for use with components ranging from minimal installations to significantly upgraded configurations. For example, the connector configuration should be compatible with a low end radio installation as well as an upgraded installation suitable for an audiophile.

A plug connector suitable for use in these applications includes a pair of spaced apart projections between which a spring on a mounting member is positioned. Deflection of the spring will result in sufficient force for mating the plug connector with a header mounted on an electrical component. Further deflection of the spring will permit desired travel of the mated connector assembly. The spring can be part of a metal mounting plate or it can be a molded spring finger on a mounting frame.

To permit lateral alignment of the plug connector relative to the header, ramp surfaces are provided on three sides of the header connector. A protruding tapered alignment pin on the plug connector engages the fourth side of the header. These ramped or inclined surfaces are sufficient to move the plug connector into lateral alignment with the header just prior to mating.

BRIEF DESCRIPTION OF THE DRAWINGS

In FIG. 9 the components are shown in a position just prior to disengagement of the header from the plug.

DETAILED DESCRIPTION OF THE INVENTION

Figure 1:
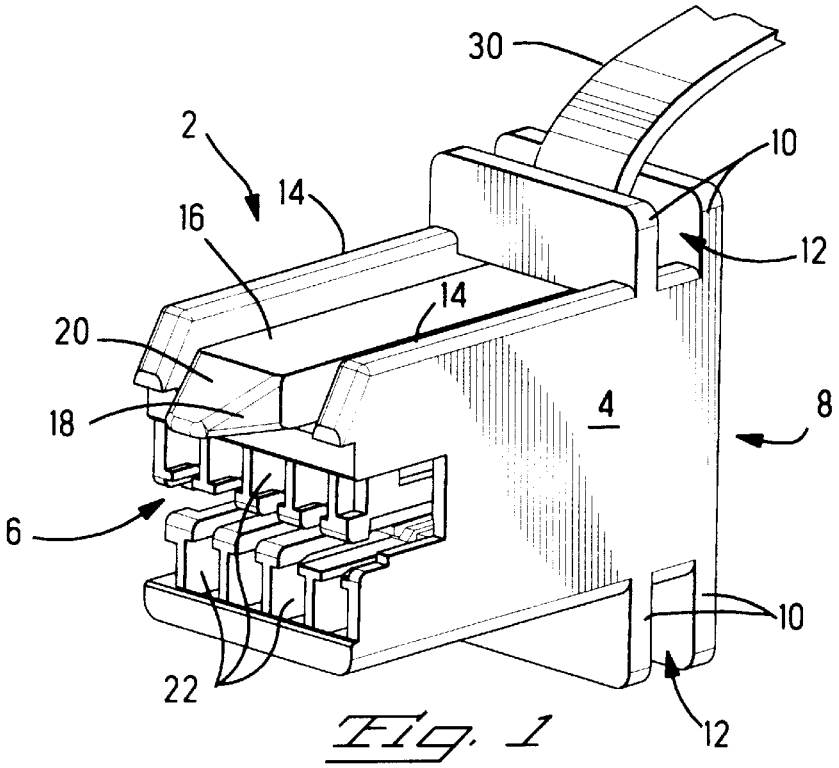
FIG. 1 is a perspective view of a plug connector housing that can be mounted to a panel and is free to float about three axes to simplify mating to a header on an electrical component.
Figure 2:
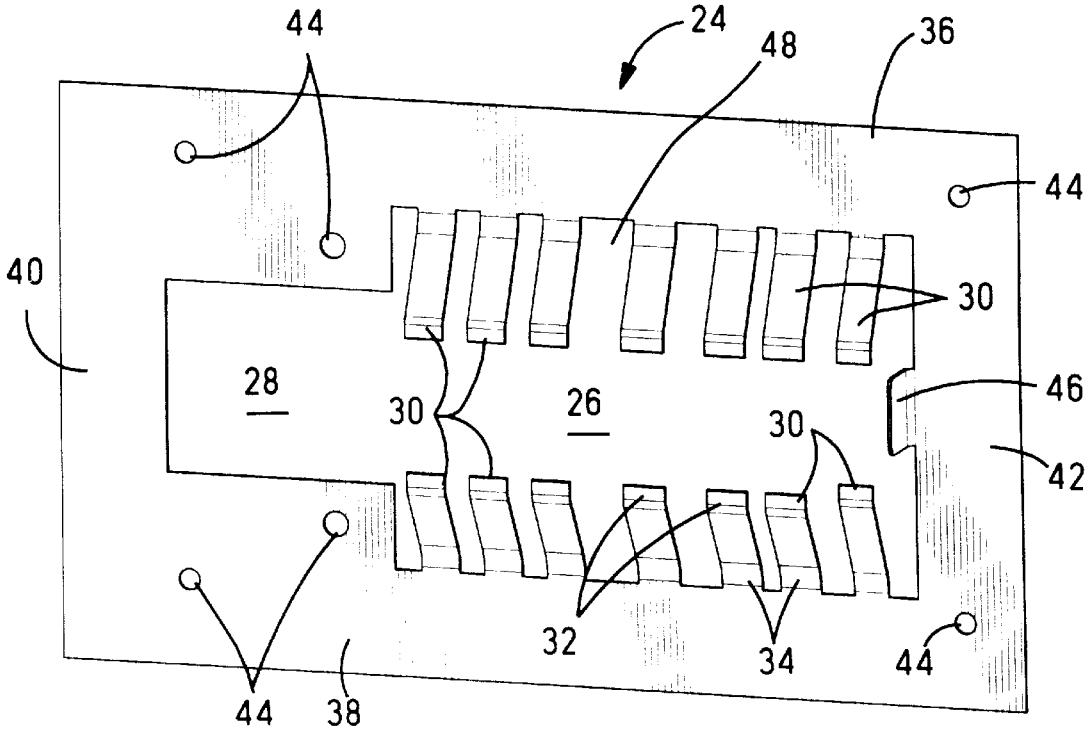
FIG. 2 is a perspective view of a mounting plate that can be secured to a panel and on which plug connectors of the type shown in FIG. 1 can be mounted.
Figure 3:
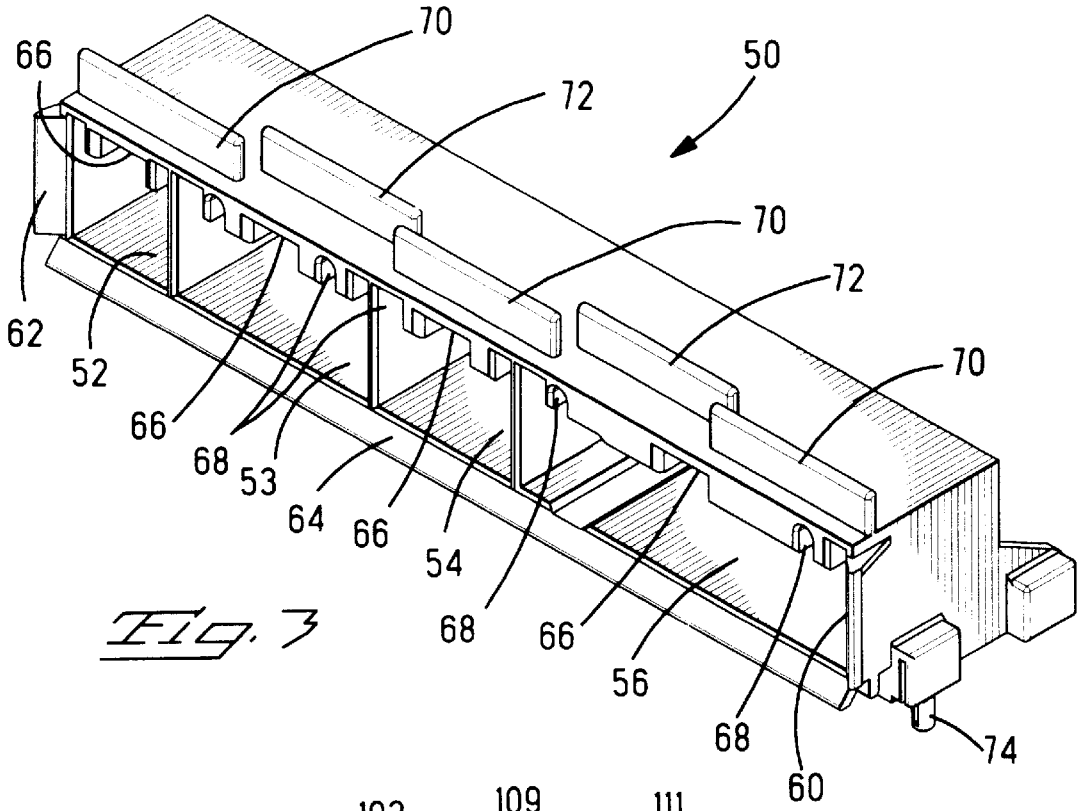
FIG. 3 is a perspective view of a header housing that provides electrical input and output to an electrical component and that mates with the plug connector shown in FIG. 1.
Figure 4:
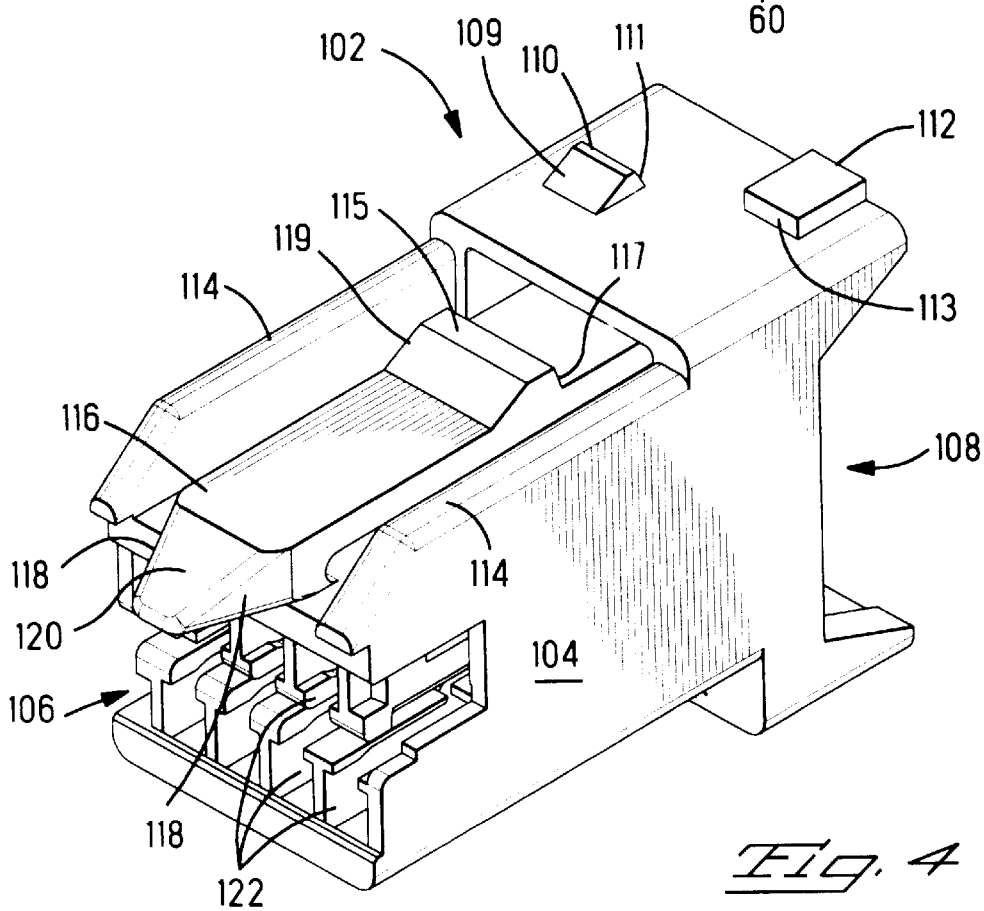
FIG. 4 is a perspective view of a second version of a plug connector that can be mounted to a panel and will be free to float about three axes to simplify mating to a header on an electrical component.

The electrical connector plug 2 shown in FIG. 1 can be mated to a header 50 shown in FIG. 3. These mating electrical connectors are intended for use in mounting an electrical component, such as a radio, in an assembly, such as an automotive dash assembly. The plug 2 can be mounted on a panel, such as a panel extending in front of the and in the rear of a dash assembly on an automobile. Typically the panel on which the plug 2 is mounted is positioned in front of other components and subassemblies, such as wiring harnesses and heater ducts. The dash is then mounted to this panel. The typical dash assembly includes openings or slots into which components, such as radios, are inserted from the front. The header connector 50 is typically mounted on the rear of the component, such as a radio, and header 50 is mated to one or more plug connectors 2. Although the connectors are dimensioned to mate properly, the location of the dash opening though which the electrical component is inserted from the front cannot be precisely maintained relative to the panel opening in which one or more plug connectors 2 are mounted. Therefore the relative position of the plug 2 and the header 50 differs from assembly to assembly, or in this case from car to car. Since the electrical component is inserted into a hole from the front, the header 50 cannot be visually aligned relative to the position of the plug 2. Therefore some means must be provided for either the plug 20 or the header 50 to float and for the connectors to blindly mate and/or self dock. For applications such as the insertion of a radio or similar component into an automotive dash subassembly, the plug 2 must be free to float in three mutually perpendicular directions. Typical specifications require the plug 2 to be free to move ±3 mm. in any direction.

To achieve the required float and to be able to dock with a header 50, a plug connector 2, or multiple plug connectors 2, are mounted on a mounting plate 24 that is in turn attached to the panel behind the dash in an automotive assembly. The plug connectors 2 are free to move in the plane of the mounting plate 24 and spring fingers 30 permit movement of the plug connector perpendicular to the plane of the mounting plate 24 and the panel on which it is mounted.

Plug connector 2 comprise an insulating housing 4 formed of a conventional thermoplastic or other suitable insulating material and a plurality of receptacle contact terminals, not shown. These receptacle contact terminals are conventional and for the preferred embodiment, receptacle contact terminals designed to mate with printed circuit board header pins can be used. The receptacle contact terminals are positioned in terminal cavities 22 that open onto a mating face 6 of the plug housing 4. These terminal cavities extend to the rear housing face 8 where the terminal are attached to wires that form part of an electrical wiring harness. The harness is typically mounted behind the automotive panel and one or more plug connectors 2 extend through openings in this automotive panel with the wires extending from the rear housing face.

Two spaced apart flanges 10 are located on the top and bottom of the plug housing 4 and mounting slots 12 are formed between adjacent mounting flanges 10. As shown in FIG. 1 one or more spring fingers 30 on mounting plates 24 are received in each slot in a manner that will be subsequently discussed in greater detail.

Two guide ribs 14 are located on the left and right sides of the plug housing 4 and extend between the front face 6 and the rear face 8 along the top face of the plug housing. A center guide post 16 is located along the top housing face between the two guide ribs 14. The front of the center guide post extends beyond the two guide ribs 14. Tapered sides 18 and a tapered top 20 merge toward the front tip of the center guide post 16 and form lead in surfaces to center the plug connector relative to the header 50 during mating. The plug connector 2 shown in FIG. 1 is an eight position connector, but connectors of this type having different numbers of terminals are commonly employed. In the present invention, multiple connectors 2 of different sizes can be mounted side by side and connected to the same header 50.

Mounting plate 24 is a metal plate stamped from a resilient material. In this preferred embodiment, the mounting plate 24 is stamped from stainless steel. The mounting plate 24 has a central opening 26 that is large enough to receive one or more plug connectors 2. A side opening 28 extending from central opening 26 is large enough to permit insertion of the largest connector 2 without engaging the mounting flanges 10 on the plug connector 2. A plurality of cantilever spring fingers 26 are stamped and formed from the metal blank forming mounting plate 24. The free ends 32 are formed out of the plane of the surrounding mounting plate. The base 34 of each cantilever spring finger 26 extends from either the top web 36 or the bottom web 38. In this embodiment, the spring fingers 26 are symmetrical along the top and the bottom of central opening 26. The top web 36 and the bottom web 38 join side webs 40, 42 and the spring fingers 26 are flexible relative to the plane of the mounting plate 24 in which the webs 26, 28, 40, 42 are located. When a plug 2 is inserted through insertion opening 28 the plug 2 remains clear of the free ends 32 of the spring fingers 30 until the plug 2 is shifted laterally into the central opening 26. At this point the spring finger free ends 32 enter the slots 12 formed by the flanges 10 as shown in FIG. 1. In an alternate embodiment, the free ends 32 of adjacent spring fingers could be joined by laterally extending sections so that the sharp edges of the ends of the spring fingers will not be exposed.

In this embodiment, the mounting plate 24 includes a plurality of holes 44 through which fasteners extend to attach the mounting plate 24 to the automotive panel, not shown. Alternatively the spring fingers could be formed on the panel itself. However the force exerted by the spring fingers formed from the panels would not be sufficient for all applications. In addition to permitting the plug connectors 2 to float for the required ±3 mm., these spring fingers 30 must also exert sufficient resistance to supply the mating force when the pins in header 50 are mated with the receptacle contacts in plug 2. For the preferred embodiment the stainless steel spring fingers 30 will exert a force of 20 pounds when deflected for the first 5 mm. This force is sufficient for mating connectors of this type and an additional 6 mm of travel of the spring fingers 30 will provide ±3 mm movement of the plug connector 2 perpendicular to the mounting plate 24 and to the panel on which it is mounted. In this embodiment, the spring fingers 30 are not evenly spaced as evidenced by a gap 48. This spring fingers 30 are not evenly spaced because they are to be aligned with individual plugs 2 to generate the appropriate mating force for plugs 2 of different sizes.

The mounting plate 24 also has a tab 46 struck up on one side of the central opening 28 which serves as a stop when the plug connectors 2 are inserted into the central opening 28.

Header 50 is a right angle pin header that is mounted on a printed circuit board, not shown. Standard printed circuit board pins are mounted in this header and extend toward the front of the header for mating with a corresponding plug connector 2. In the embodiment depicted in FIG. 1, the header has four cavities 52, 54, 56, and 58, of different sizes. One plug connector 2 is to be received in each cavity and the pins are aligned in the appropriate cavity for mating with receptacle contacts located in terminal cavities 22 in plug 2. Ramping surfaces 60, 62 and 64 are located on three sides of the front of the header 50. Inwardly inclined ramps 60 and 62 are located on the left and right sides of the header 50 and a ramp 64 is located along the bottom of the header. No ramp is located on the top of header 50. The top of each cavity in header 50 includes a central latch groove 66 that is flanked by two guide rib grooves 68 that are dimensioned to receive plug guide ribs 14. The central latch groove 66 is dimensioned to receive the tapered alignment post 16 as well as a latching post on prior art plug connectors used on some conventional harness assemblies. These grooves 66 and 68 would be obstructed if a guide ramp were to be located along the top of header 50. A partial ramp that would not obstruct grooves 66 and 68 could be provided along the top of header 50, especially for larger header sizes. The tapered front of the plug connector alignment post 16 engages the top wall of each cavity and the latch groove 66 to insure that the plug 2 is captured along the top of the header 50. Ramp surfaces 60, 62, and 64 insure that the plug connector 2 is captured along the other edges of the header so that the plug 2 and the header 50 are self centering for blind docking and mating. Adequate movement in the plane of the mounting plate and parallel to the automotive panel is permitted because the mounting slots 12 permit the plug connectors 2 to move laterally relative to the mounting plate 24 and the mutual engagement of alignment post 16 and guides 14 with grooves 66 and 68 assures any necessary alignment of the header and the electrical component in the dash opening.

The header 50 also includes front panel stops 70 and offset rear panel stops 72 for engaging the front of the casing of the electrical component on which the header is mounted by the printed circuit board posts 74.

FIGS. 4–9 show an alternate assembly of components that could be used to blind mount an electrical component on a panel. This approach could also be used to mount a radio into a dash assembly on an automobile and would provided the same freedom for the plug connector 102 and the mating header 150 to float for ±3 mm. in any of three mutually perpendicular directions. The assembly shown in FIGS. 4–9 includes a mounting frame 124 in which the plug connector is free to travel, within prescribed limits, perpendicular to the panel in which the assembly is mounted.

Figure 5:
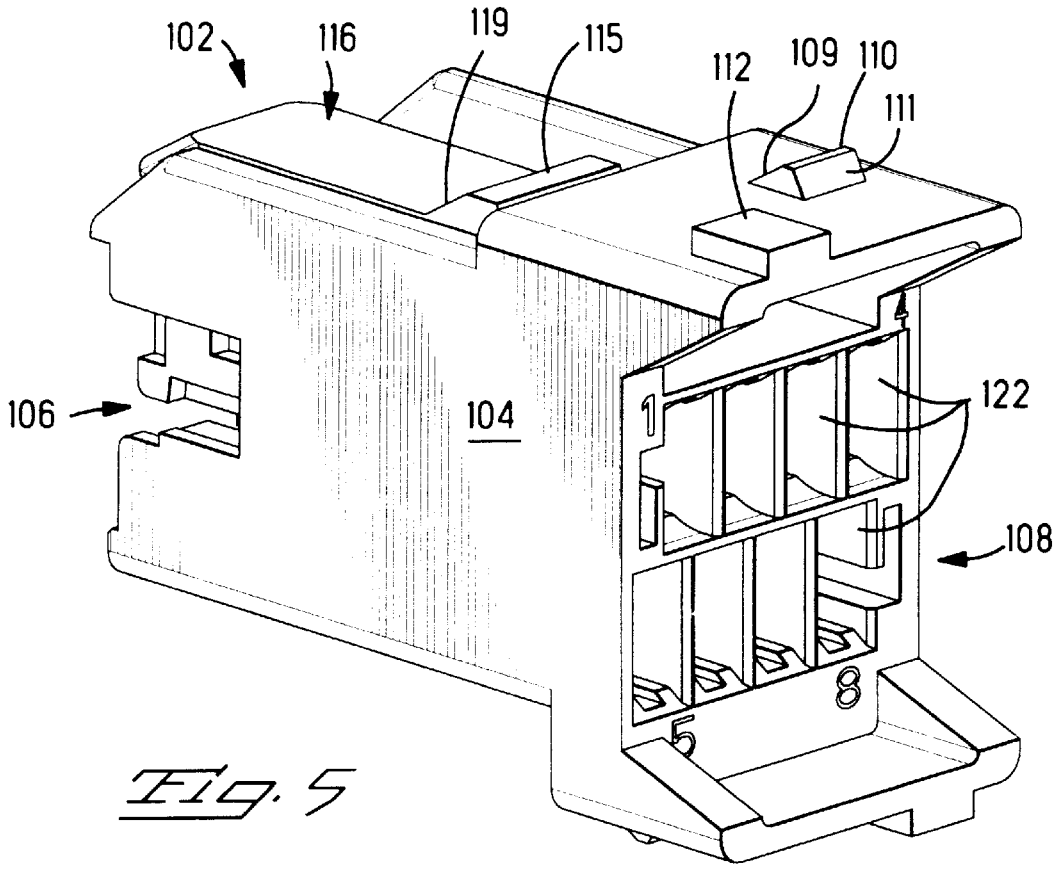
FIG. 5 is a perspective view of the second version of the plug connector housing shown in FIG. 4 showing the rear face of the housing thorough which terminated wires of a harness are inserted.
Figure 6:
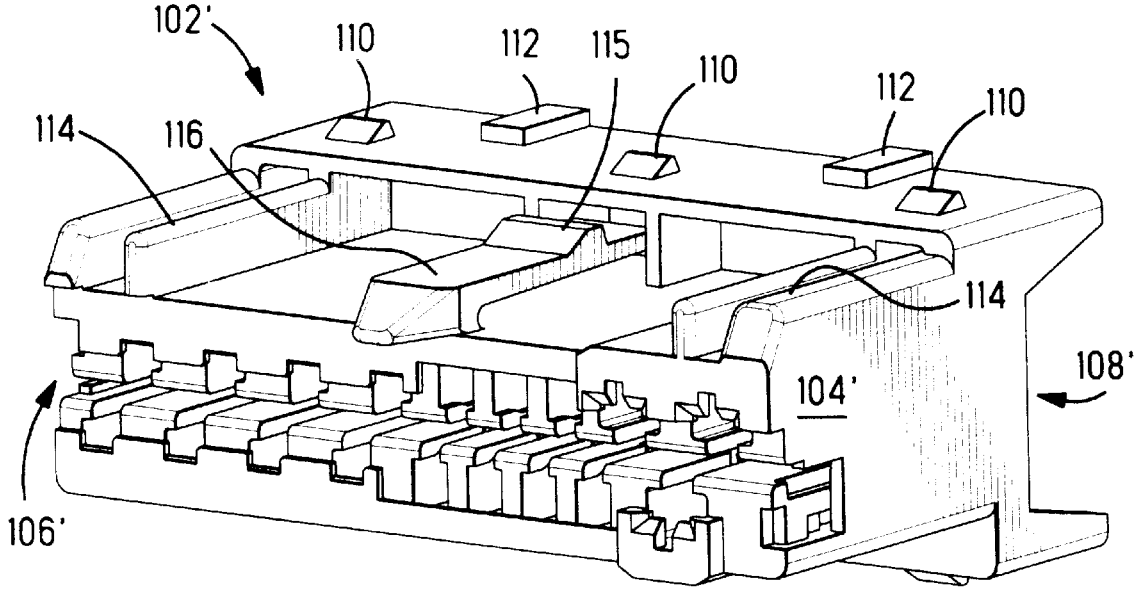
FIG. 6 is a perspective view a plug connector of the same type as the second version shown in FIG. 4. The plug connector shown in FIG. 6 is a larger size connector in which more terminals would be positioned.

The plug connector 102 includes an insulating housing 104 that is similar to the housing 4 shown in FIG. 1. The rear of plug connector housing 104 is shown in FIG. 5. The connector housing 104 includes terminal cavities 122 extending between a front face 104 and a rear face 108. These cavities receive conventional receptacle contacts of the same type used in the plug connector 2 shown in FIG. 1. Receptacle contact terminals would be crimped to individual wires in a harness and the terminals would be inserted into the terminal cavities 122 through the rear housing face 108. The plug connector 102 is an eight position connector. An eighteen position plug connector 102' of the same type is shown in FIG. 6.

Plug connector 102 includes guide ribs 114 on the top of the housing 104 that have the same configuration and function as guide ribs 14 shown in FIG. 1. Alignment post 116 extends beyond the front housing face 106 and includes tapered surfaces 118 and 120 that serve to align the plug connector 102 with a header slot in the same manner as the guide post 16 in connector 2. Guide post 116 is a flexible cantilever beam joined to the housing at its rear and post 116 includes a snap latch boss 115. Snap latch boss 115 has a rear inclined surface 117 and a front inclined surface 119. The slope of the rear inclined surface 117 is greater than the slope of the front inclined surface 119 so that it will require a greater force applied to camming surface 117 to deflect the post 116 than would be required to deflect the post 116 upon engagement with surface 119. In other words the insertion force for plug connector 102 (into header 150) will be less than the extraction force.

The plug connector housing 104 also includes two other mating or latching projections on the top and on the bottom of the housing adjacent to the rear face 108. The first rear latching projection is a camming boss 110 that includes inclined surfaces 109 and 111 on the front and back respectively. As can be seen by comparing FIGS. 4, 5 and 9 the inclination of the rear surface 111 is greater that the inclination of the front surface 109 so that the insertion force of the plug connector (into mounting frame 124) will be greater than the extraction force.

The other latching projections 112 on the top and the bottom of the housing are square edge latching stops. These stops have a front surface 113 that extends perpendicular to the upper or the lower surface of the plug housing 104 and as will be seen will prevent forward extraction of plug connector 102 from mounting frame 124. As shown in FIG. 6 the larger connector 102' includes multiple camming bosses 110 and latching stops 112 on the top and on the bottom of the connector housing 104'.

Figures 7, 8:
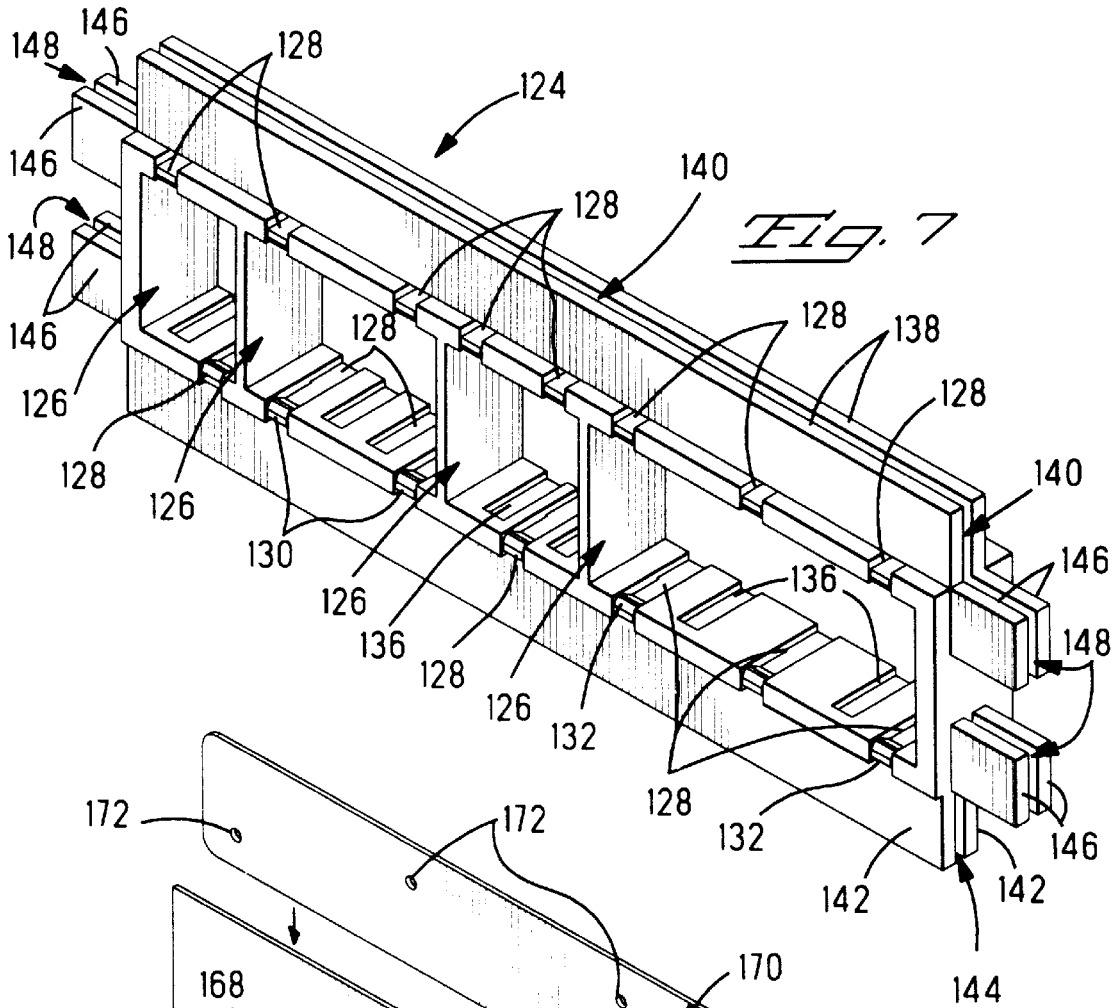
FIG. 7 is a perspective view of a mounting frame that can be positioned on a panel. The plug connectors shown in FIGS. 4–6 can be mounted in this mounting frame.
FIG. 8 is a view of a mounting plate that can be attached to a panel. The mounting frame shown in FIG. 7 can be mounted in this mounting plate. Alternatively an opening corresponding to the opening in the mounting plate can be provided in the panel.

The mounting frame 124 in which multiple plug connector 102 and 102' can be mounted is shown in FIG. 7. The plug connectors 102 and 102' will be free to travel for at least ±3 mm. in a direction perpendicular to mounting frame 124 and to a panel in which the mounting frame 124 is in turn mounted. The mounting frame 124 is in turn free to move for the requisite travel in the plane of the panel.

Mounting frame 124 includes multiple windows 126 that extend through the mounting frame 124 between the front and the back. These windows 126 are of different sizes. The plug connector 102 would be received in the leftmost window 126 shown in FIG. 7. The larger plug connector 102' shown in FIG. 7 could be inserted into the rightmost window 126 shown in FIG. 7.

Figure 9:
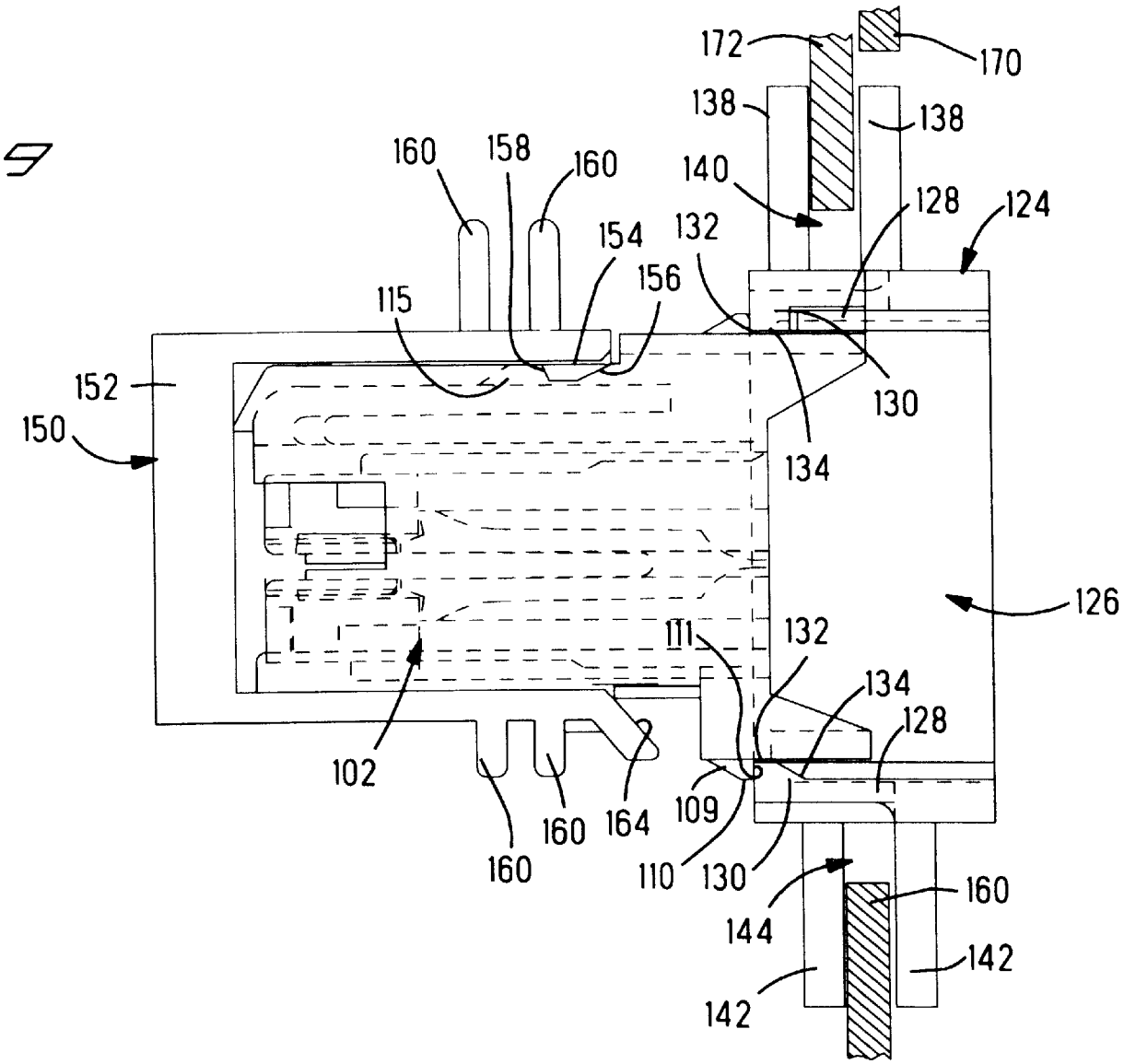
FIG. 9 is a view showing the mounting frame mounted in the mounting plate with the plug housing mounted in the mounting frame in an extended position. The header is shown mated with the plug housing.
Figure 10:
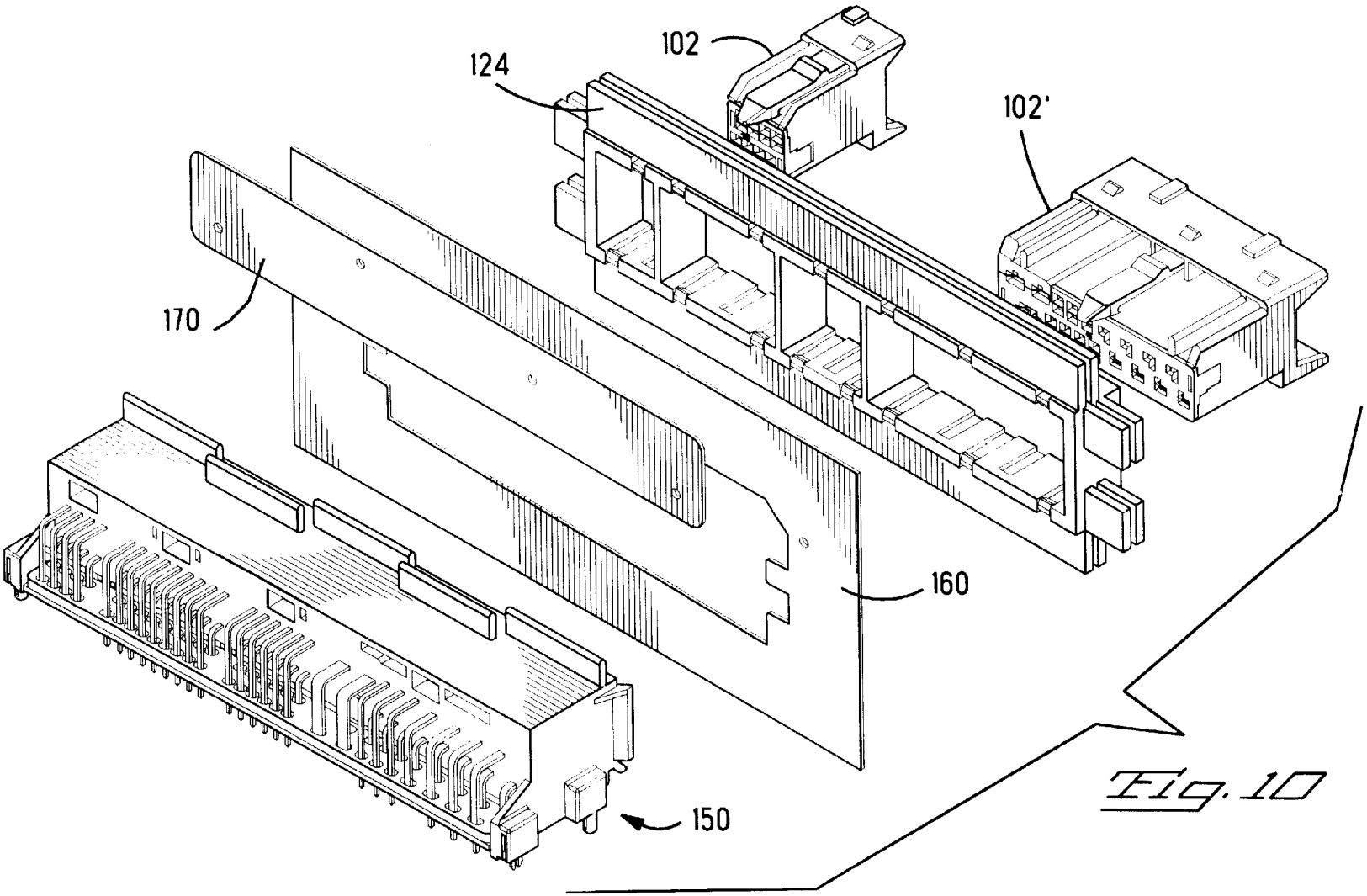
FIG. 10 is an exploded perspective view showing the components of FIGS. 4–8.

Mounting frame 124 can be molded from a thermoplastic that has sufficient resiliency for the use of flexible springs 128 that are molded along the top and the bottom of the windows 126. Each of these flexible springs 128 comprises a cantilever beam that is integrally joined to the mounting frame 124 at its base. A latching spring head 130 faces into a corresponding window 126 at the free end of the spring 128. The latching head 130 will be located at the front face of the mounting frame 124. As shown in FIG. 9, the front camming surface 132 has a slope that is greater than the rear camming surface 134 to that it will take a greater force to deflect spring 128 upon engagement with front camming surface 132 than upon engagement with rear camming surface 134. The latching springs 128 are located for engagement with the camming bosses 110 on the top and bottom of the plug connector housings 104 when the plug connectors 102 are inserted into the windows 126.

In addition to the latching springs 128, closed end channels 136 are also located along the top and bottom edges of the windows 126. These channels 136 are open toward the rear of the mounting frame 124, but they are closed along the front and do not extend to the front face of the mounting frame 124.

Two spaced mounting flanges 138 are located along the top of mounting frame 124 defining an upwardly facing mounting slot 140 extending between the ends of the mounting frame 124. Two lower mounting flanges 142 are located on the lower surface of mounting frame 124 defining a downwardly facing mounting slot 144 extending between opposite ends of the mounting frame. As best shown in FIG. 9, the upper flanges 138 are offset relative to the lower flanges 142 so that the upper mounting slot 140 is located in front of the lower mounting slot 144. Two sets of end mounting flanges 146 are located on each end of the mounting frame 124 to define end mounting slots 148 that are in the same plane as the lower mounting slot 144 and offset relative to upper mounting slot 140.

FIG. 8 shows a mounting plate 160 in which the mounting frame 124 is positioned. Although FIG. 8 shows a separate mounting plate 160 it should be understood that mounting plate 160 could comprise a section of a larger panel. Mounting plate 160 includes an opening 162 which includes two extensions 166 on each end. These extensions 166 are formed by two tab sections 164 that extend into the opening 162. An auxiliary mounting plate 170 can be attached to the mounting plate 160 by conventional fasteners inserted through holes 168 and 172 on the mounting plate 160 and on the auxiliary mounting plate 170 respectively. The mounting frame 124 is mounted in central opening 162. To insert the mounting frame 124 into this opening, the end flanges 146 are aligned with opening extensions 166 and the mounting frame is inserted into the opening 162. The mounting frame is then moved downwardly until the bottom edge forming opening 162 is received in the lower slot 144 on the mounting frame 124. The tabs 164 will then be received in end slots 146 on the mounting frame 124. The auxiliary mounting frame 172 is then inserted into the offset upper mounting frame slot 140 and the auxiliary mounting plate 170 is fastened to the mounting plate 160. The mounting frame 124 remains free to shift in the plane of the mounting plate 160, but it cannot move perpendicular to the mounting plate or to the panel on which it is in turn mounted. The gaps between plates 160, 170 and the flanges 138, 142 are exaggerated for illustrative purposes in FIG. 9.

The manner in which the plug connector 102 is positioned in mounting frame 124 can be seen in FIG. 9. Each plug connector 102 or 102' is inserted into a corresponding mounting frame window 126 through the rear of the mounting frame 124. To insert the plug connector, the latching stops 112 are aligned with a corresponding channels 136. Camming bosses 110 will then be aligned with corresponding spring fingers 128. The plug connector 102 is inserted through the mounting frame 124 until stops 112 engages the closed ends of channels 136. Further movement in this direction is not possible. As the plug connector is inserted, the inclined camming surface 109 will engage the spring finger camming surface 132 to cam the spring finger heads 130 out of the way. After the spring fingers return to their normal position the more steeply inclined surfaces 111 and 132 will be in engagement as shown in FIG. 9 meaning that more force must be supplied to cause the spring fingers heads 130 to be again cammed out of the way.

FIG. 9 also shows the manner in which the plug connector 102 is mounted in mounting frame 124 and the manner in which a header 150 is mated to the plug connector 102. The header 150 is substantially the same as the header 50 shown in FIG. 3. For example header 150 includes inwardly inclined ramps as evidenced by the lower ramp 164 shown in FIG. 9. The header housing includes a latching projection 154 having a ramped inner surface 158 and a ramped outer surface 156. The slope of outer surface 156 is greater than the slope of inner surface 158. The latching projection 154 is positioned to engage snap latch 115 on the plug connector alignment post 116, and the latching projection 154 would be positioned in a latching groove corresponding to the latching groove 66 shown in FIG. 3. With the plug connector 102 in the extended or home position shown in FIG. 9, the header 150 is inserted toward the plug connector. A minimum mating force must be exerted to permit the standard pins in header 150 to mate with the standard receptacle contact terminals that would be positioned in plug connector 102. The spring fingers 120 have sufficient strength to insure that sufficient mating resistance is developed before moving out of the way. The greater slope of the surfaces 111 and 132 make this force greater then the force necessary to insert plug connector 102 into the mounting frame 124. As shown in FIG. 6, larger plug connectors 102' with more terminals, requiring more mating force, have more camming bosses 110. As pins are fully mating with corresponding terminals, the alignment post 116 is deflected by engagement between snap latch 115 and projection 154 that secure header 150 to the plug connector 102. Continued movement of the header-plug connector subassembly causes spring fingers 128 to return to their normal position. The plug connector 102 is now free to move relative to the mounting frame 124 by at least the ±3 mm travel required to account for any misalignment between a panel and a dash subassembly in which the component, such as a radio, is to be mounted. Even thought the rear of channels 166 are open, the plug connector cannot slip out of this channel because the header 150 and the component on which it is mounted cannot move further in this direction. Alternatively an auxiliary latch can be provided to retain plug connector 102 in mounting frame 124. The header 150 can be disengaged from plug connector 102. The relative position of the components shown in FIG. 9 is just prior to disengagement of the header 150 from the plug connector 102. The force required to disengage snap latch 115 from projection 154 is greater than the force required to deflect mounting frame snap fingers 128 when the plug connector is pulled to the left in FIG. 9. However upon engagement of stops 112 with the ends of channels 136, the alignment post 116 will be deflected and snap latch 115 will be disengaged from projection 154 leaving the plug connector in position for insertion of another electrical component. A radio or similar component can be inserted and removed in this manner.

We claim:

1. An electrical connector for connecting an electrical component to a wiring harness to which the electrical connector is attached, the connector comprising:

a connector housing including at least one pair of first and second spaced apart projecting means located adjacent a rear face of the connector housing, and a mounting member including at least one spring initially engaging the connector housing between corresponding ones of the first and second projecting means, the spring, when deflected, exerting a force on the connector in a first axial direction at least equal the force required to mate the electrical connector with a mating connector inserted into mating engagement in the first axial direction, the spring being further deflectable after the connectors are mated to permit axial movement of the mated connectors in the first axial direction.

2. The electrical connector subassembly of claim 1 wherein the mounting member is a stamped metal plate with a plurality of cantilever springs extending into a central opening, the connector being received within the central opening with free ends of the springs extending between the first and second projections.

3. The electrical connector subassembly of claim 1 wherein the mounting member comprises a mounting frame having at least one window through which the electrical connector can be inserted, the springs comprising cantilever beams located along edges of each window, each cantilever beam including a head projecting inwardly and received within the two spaced apart projections on the connector.

4. The electrical connector subassembly of claim 1 wherein one of the projections comprises a camming boss, the camming boss deflecting the cantilever beam to permit the camming boss to move past the projecting cantilever beam head after the connectors are mated.

5. The electrical connector subassembly of claim 4 wherein the mounting frame includes a closed end channel, the second projection extending into the channel to prevent disengagement of the connectors from the mounting frame when the mating connectors are disengaged.

6. The electrical connector subassembly of claim 5 wherein the camming boss engages the cantilever beam head to flex the cantilever beam to permit the camming boss to move past the cantilever beam head as the mated connectors are disengaged.

7. The electrical connector subassembly of claim 1 wherein the mounting member is mounted on a panel, the mounting member being free to move through a prescribed displacement in the plane of the panel, the springs deflecting to permit the connector to move through at least a prescribed displacement perpendicular to the plane of the panel.

8. The electrical connector of claim 1 wherein the projecting means comprise flanges extending between opposite sides of the electrical connector.

9. The electrical connector of claim 1 wherein the mounting member is molded.

10. The electrical connector of claim 1 wherein the connector comprises a plug connector matable with a pin header mounted on an electrical component.

* * * * *